United States Patent [19]

Campo et al.

[11] Patent Number: 4,561,803

[45] Date of Patent: Dec. 31, 1985

[54] CONDUCTOR GUIDE SYSTEM FOR OFFSHORE DRILLING PLATFORM

[75] Inventors: Juan J. Campo, Metairie; John A. Crutti, Sr., Harvey, both of La.

[73] Assignee: McDermott International, Inc., New Orleans, La.

[21] Appl. No.: 562,545

[22] Filed: Dec. 19, 1983

[51] Int. Cl.[4] ..... E21B 7/12; E02B 17/02

[52] U.S. Cl. ..... 405/224; 175/9; 405/195

[58] Field of Search ..... 405/195, 203, 224, 227, 405/228; 166/341, 349; 175/5, 7, 9

[56] References Cited

U.S. PATENT DOCUMENTS

| | | | |
|---|---|---|---|
| 4,030,310 | 6/1977 | Schirtzinger | 405/195 |
| 4,108,255 | 8/1978 | Smith | 175/9 |
| 4,444,275 | 4/1984 | Beynet et al. | 175/7 |
| 4,469,181 | 9/1984 | Kellett | 405/195 X |

*Primary Examiner*—David H. Corbin

*Attorney, Agent, or Firm*—Robert J. Edwards; D. Neil LaHaye; James C. Simmons

[57] ABSTRACT

A conductor guide assembly for conductors of an offshore well platform having a jacket with an interior pile for extending from a sea bed to above a water level which is over the sea bed. In accordance with one inventive feature, a first guide mechanism comprising a plurality of vertically spaced supports which hold the tubular conduits within the interior pile is assembled in a plurality of sections wherein the upper support of each section is provided with removable bolt-on units for supporting the first guide mechanism as successive sections are joined thereto. In accordance with another inventive feature, a second guide mechanism comprises a pair of circular plates positioned to rotate within a lower deck opening and which are connected together and define a plurality of passages for receiving the plurality of conductors that extend in the interior pile. The connected plates are temporarily attached to the lower deck for transport so that the second guide mechanism can be detached and rotated to align the passages with the intended positions for the conductors whereafter the second guide mechanism is permanently attached to the lower deck. In accordance with another inventive feature, a third guide mechanism comprising a plurality of radially extending beams is supported on an upper deck. The second guide mechanism also has passages for access to the conductors and it too can be rotated into a position of alignment with the conductors and thereafter permanently fixed to the upper deck.

14 Claims, 13 Drawing Figures

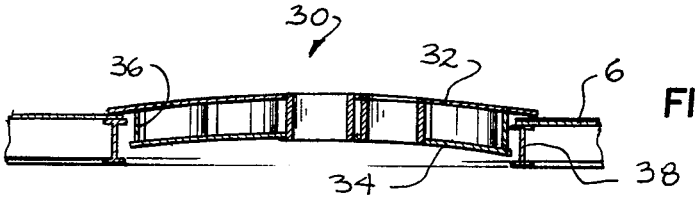
FIG. 8
FIG. 7
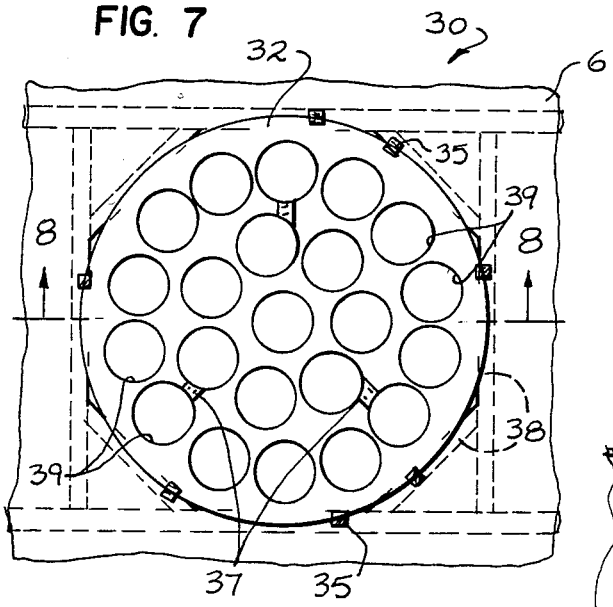
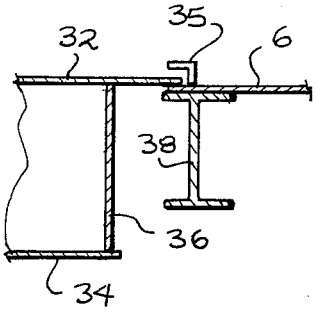
FIG. 9

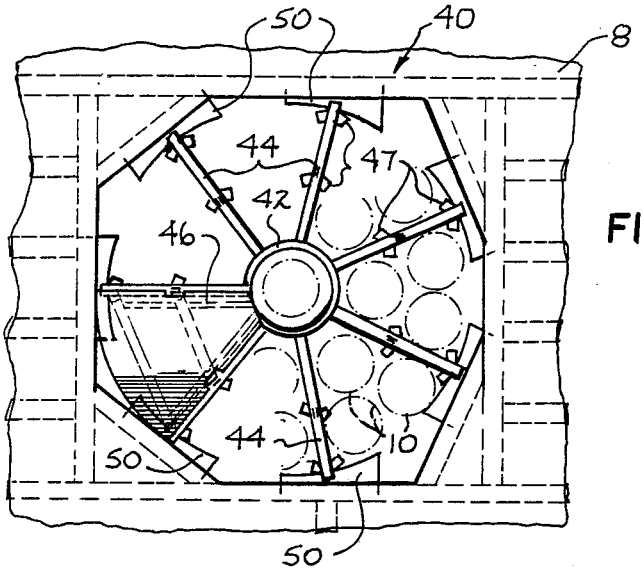
FIG. 10
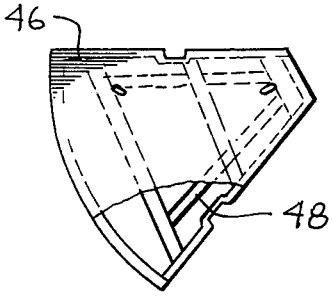
FIG. 11
FIG. 12
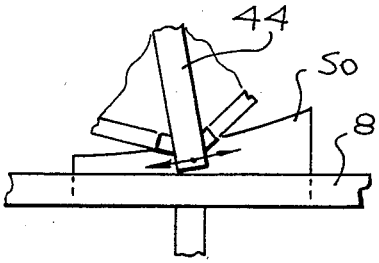
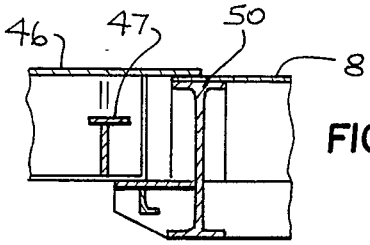
FIG. 13

CONDUCTOR GUIDE SYSTEM FOR OFFSHORE DRILLING PLATFORM

FIELD AND BACKGROUND OF THE INVENTION

The present invention relates in general to offshore drilling platforms. More particularly, it relates to a new and useful conductor guide arrangement for positioning a plurality of tubular conductors used in an offshore drilling platform which conductors extend upwardly through a pile of the platform jacket.

The drilling of wells at offshore locations using offshore platforms is accomplished through large diameter steel pipes, called conductors, which are driven into the soil at the sea bed through guides connected to a jacket and deck structure of the offshore platform. The jacket is a tubular steel framework that serves as a pile template and extends from the sea bed to a few feet above the water level. Steel superstructure of the platform including decks are connected to the piling or the jacket to support the drilling and production facilities.

The piling consists of steel tubes which secure the platform to the sea bed and penetrates the soil up to 300 to 600 feet. The platform components such as the jacket, one or more decks, and piling, are built on land at fabrication yards as completely as possible in order to minimize the far more expensive offshore construction at the offshore site.

Conductor guides for positioning and guiding the conductors are framed at various elevations within the jacket and decks to provide support for the conductors such that the usual effects of environment such as waves, winds, current and the like can be safely withstood by the conductors and to maintain conductor alignment.

There are two kinds of conductor guide systems which have been utilized in the offshore industry. The first system, which is more common and older, consists of guides which are rigidly connected to the jacket and deck framework. The conductors are placed through these guides. The conductor guides and structural framework provide support for the conductors at various levels throughout the jacket and deck or decks. This type of system generally includes three kinds of conductor guide assemblies. The first kind are those within the horizontal framework levels of the jacket and typically consist of vertical guides made out of steel tubes welded to the horizontal jacket tubular members. The other types are located in the upper and lower deck levels. The lower deck level guides are similar to those of the jacket except that they are rigidly connected to the deck floor beams. These guides are located in line with the jacket guides. The upper deck level assembly consists of a grid of beams bolted to the permanent upper deck beams supporting removable hatches which line up with the conductor guides in the lower deck. Access is provided to the lower deck level, which is typically the conductor termination level, by removing the hatches. While advantages of this type of system include the fact that conductor guides and framing are normally built within the jacket and deck during land fabrication, when jackets are set over existing wells, offshore construction thereof is required. Another problem is that this type of arrangement may not sufficiently withstand extreme environmental effects such as mud slides or ice movement.

The second type of arrangement, which has recently been utilized in areas of extreme environmental loading such as mud slide zones, consists of jacket conductor guides positioned inside a large diameter pile which has previously been driven through a jacket sleeve. The pile protects the conductors from environmental loading. The typical jacket conductor assembly consists of a series of horizontal guide frames connected to a central post and supported by the pile at its top. Additional guide assemblies similar to those detailed with respect to the first type of arrangement are provided in the decks of the platform. Because the jacket conductor guide assembly must be erected offshore after the jacket and piling are installed, it is required that the conductor guides for the deck sections be built offshore to conform to the orientation of the conductor guides in the pile.

Due to its length, the jacket assembly is built on land in several sections which are subsequently installed and welded together offshore. However, temporary beams are required for supporting the structure as it is assembled and installed at the offshore site. The handling of such beam supports on the top of the pile for large guides is time consuming and sometimes requires the use of cranes or similar equipment. As the jacket structures have become larger and larger, such beam supports have become more and more difficult to handle.

The present invention is drawn to a conductor guide assembly and method of assembling the same for a plurality of conductors for an offshore drilling or well platform. A first conductor guide means is disposed in and supported by and on the interior pile which extends through the jacket from below the sea bed to above the water level over the sea bed.

In accordance with one inventive feature, a second guide means is associated with at least one lower deck of the platform that is connected to the jacket. A plurality of passages are defined in the second guide means through which the conductors extend and are positioned with respect to the lower deck. The second guide means is temporarily connected such as by spot welding to the lower deck at the land based fabrication facility. It can thus be detached temporarily so that it can be rotated to align the passages with the plurality of conductors or at least the positions for the conductors in the interior pile. Thereafter, the second guide means is permanently connected, usually by welding, to the lower deck.

In accordance with another inventive feature, a third guide means is provided on the upper deck which also has a plurality of passages for permitting access to the plurality of conductors. The third guide means is supported by beams in the upper deck which permit limited rotation of the third guide means to align passages thereof with the passages of the second guide means.

In accordance with another inventive feature, the first guide means comprises a plurality of frame arrangements which are each equipped with removable bolt-on units that can be used to support the unfinished first guide means as sections thereof are assembled above the interior pile. The bolt-on units can then be removed to drop the first guide means, section by section, into the interior pile as additional sections are added.

Accordingly, an object of the invention is to provide a conductor guide arrangement which facilitates the positioning and guiding of conductors in an offshore platform so that the amount of construction work required at the offshore site is minimized.

A further object of the invention is to provide a method for assembling such a conductor guide arrangement.

Yet another object of the invention is to provide a method for assembling a conductor guide arrangement wherein the burdensome requirement of using temporary beams to support the structure is eliminated.

A still further object of the invention is to provide a conductor guide arrangement for offshore platforms which is simple in design, rugged in construction, and economical to manufacture.

The various features of novelty which characterize the invention are pointed out with particularity in the claims annexed to and forming a part of this disclosure. For a better understanding of the invention, its operating advantages, and specific objects attained by its uses, reference is made to the accompanying drawings and descriptive matter in which preferred embodiments of the invention are illustrated.

IN THE DRAWINGS

FIG. 7 is a top plan view of second guide means for positioning and guiding the conductors in a lower deck of the platform;

FIG. 8 is a view taken along lines 8—8 of FIG. 7;

FIG. 9 is an enlarged detailed view of the relationship between the second guide means and the lower deck;

FIG. 10 is a top plan view of a third guide means connected to an upper deck of the platform for providing access to the conductors;

FIG. 11 is a top plan view of a hatch used in the structure of FIG. 10;

FIG. 12 is a detailed top plan view of the association between the third guide means and the upper deck; and FIG. 13 is a sectional detail view showing the support of the third guide means on the upper deck.

Figure 1:
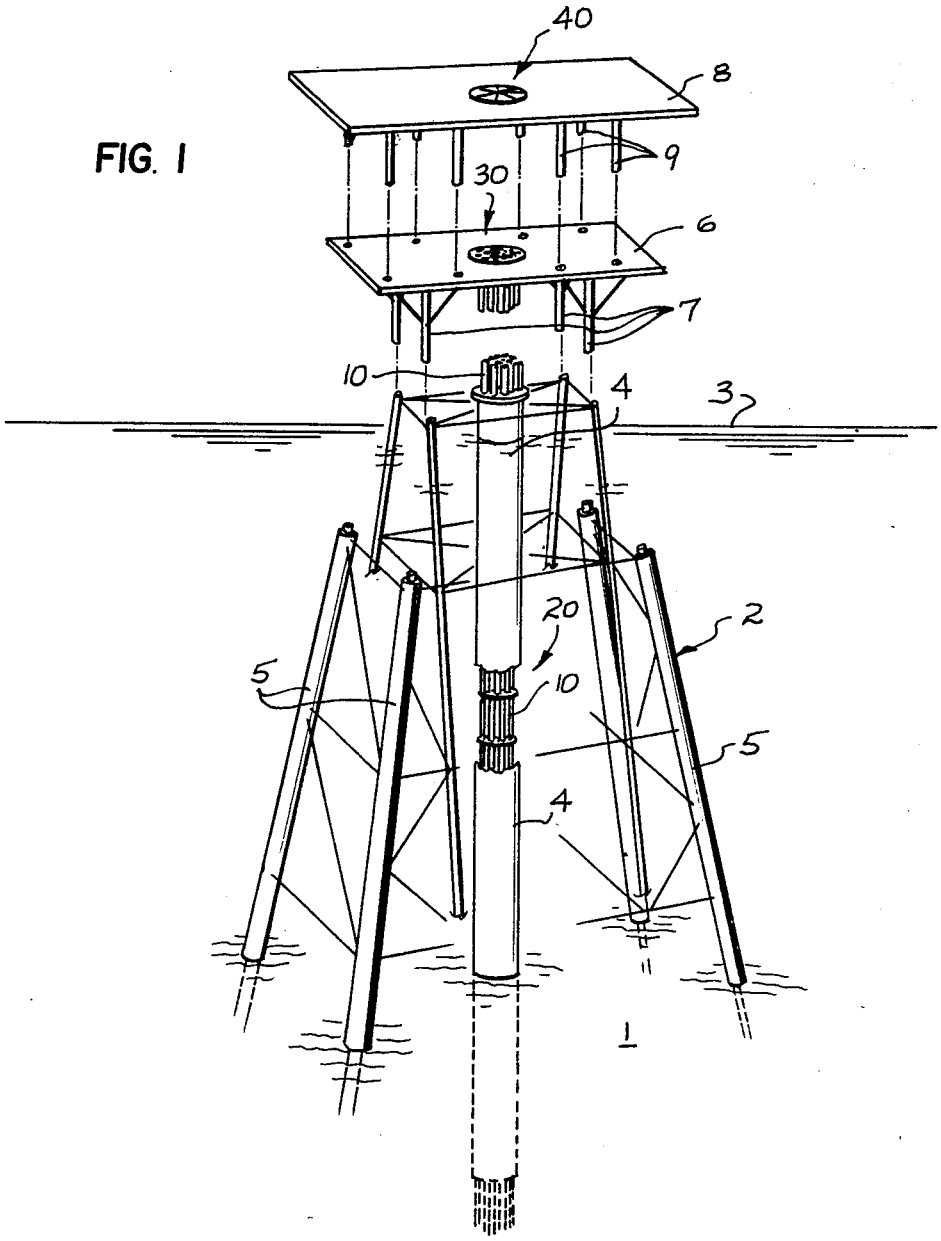
FIG. 1 is an exploded perspective view of an offshore platform with conductors and a conductor guide assembly according to the invention.
Figure 2:
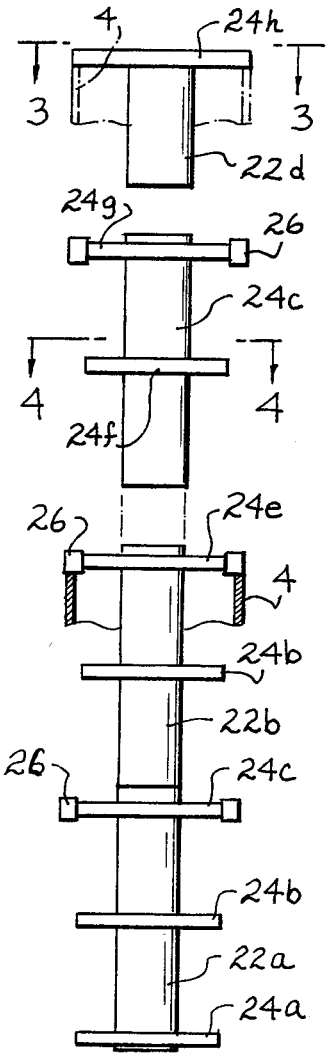
FIG. 2 is a side elevational and exploded view of first guide means for positioning conductors in an interior pile of the offshore platform.

Referring to the drawings in particular, an offshore drilling platform is shown in FIG. 1 which is connected to a sea bed 1 and extends up to and above a water level 3 above the sea bed. The platform includes a jacket generally designated 2 which is a framework made of steel tubing and generally includes four corner piles 5 which are sunk into the soil of the sea bed or otherwise anchored to the sea bed.

A pile 4 extends through the interior of the jacket 2. This is a tubular structure that is typically between about 8 and 15 feet in diameter and may be inserted in a sleeve which has been fabricated and installed in the jacket ashore. The pile 4 may be driven into the sea bed for up to 300 to 600 feet.

Interior pile 4 extends to a few feet above the water level 3 and contains a plurality of conductors 10 through which access can be had to the sea bed and below. The conductors each have a diameter of typically between about 20 and 30 inches and are positioned and guided in the interior pile 4 by first guide means generally designated 20 to be described in detail hereinunder.

The platform is provided with one or more lower decks 6 and at least one upper deck 8. Decks 6 and 8 are connected to the jacket through supports 7 and 9 respectively.

Second guide means generally designated 30 are connected to the lower deck 6 and define passages for the conductors 10. Third guide means generally designated 40 are connected to the upper deck 8 and also define passages which are aligned with the passages of the second guide means 30 and provide access to the tops of the conductors.

As shown in FIGS. 2 through 6, the first guide means 20 is made up of a plurality of sub-assemblies which each include a vertical center post **22*a* through 22*d*. Sections 22*a*, 22*b*, and 22*c*, which are adapted to be received entirely within the interior pile 4, each include one or more but preferably at least two steel frame structures 24*a* through 24*c* for section 22*a*, 24*d* and 24*e* for section 22*b*, and 24*f* and 24*g* for section 22*c*. The upper structure 24*c*, 24*e*, and 24*g* of each section 22*a*, 22*b*, and 22*c* respectively is provided with a plurality of removable support brackets 26 which establish an effective outer diameter for the structures which is greater than the diameter of the interior pile 4**.

The steel frame structure **24*h* at the top of the top section 22*d* has an outer diameter (without any support bracket) which is greater than the diameter of the interior pile 4 so that it can be permanently supported on top of the interior pile 4** to support and suspend the remainder of the second guide means thereunder.

Figure 3:
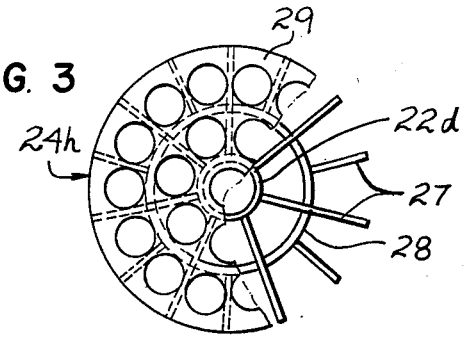
FIG. 3 is a view taken along lines 3—3 of FIG. 2.

As shown in FIG. 3, the uppermost steel frame **24*h* includes a plurality of steel plate spokes 27 extending radially outwardly of the center post 22*d*, an intermediate ring 28 and outer ring 31 which are also made of steel plate, and an upper plate 29 having apertures therein for receiving a plurality of conductors 10**.

Figure 4:
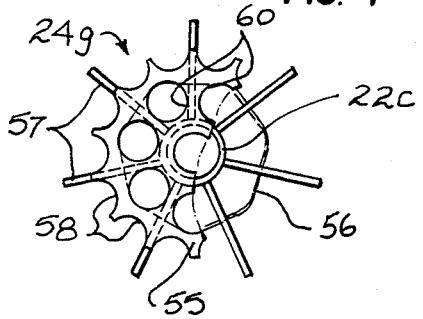
FIG. 4 is a view taken along lines 4—4 of FIG. 2.

As shown in FIG. 4, a steel frame structure **24*f*, which is typical of all the frame structures except for the top frame structure 24*h*, comprises a plurality of steel spokes 57 extending radially outwardly of the center post 22*c*, a conductor engaging band 56, and a cover plate 55. As shown in FIG. 4, cover plate 55 includes semicircular recess 58 as well as openings 60 aligned with similar recesses 58 and openings 60 in other cover plates for positioning a plurality of the conductors 10 at selected locations. In a similar way, plate 28 of frame structure 24*h* provides aligned apertures for positioning of the conductors in the same pattern. The center posts 22*a* to 22*d* may also serve as conductors. Although sufficient alignment may be provided by positioning conductors between semicircular recesses 58 and the piling wall, the plurality of spokes 57** are preferably provided to extend outwardly to the piling wall for maintaining concentricity.

Figure 5:
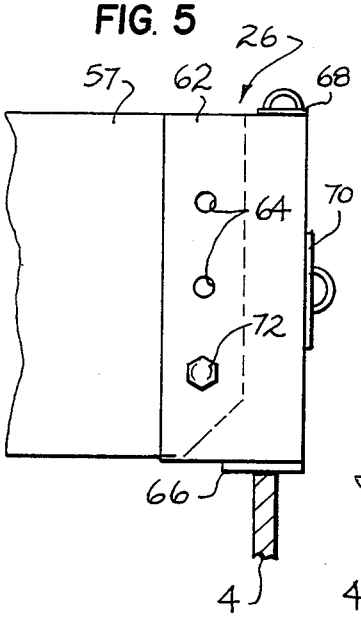
FIG. 5 is a detailed view of a removable support bracket for the structure of FIG. 2.
Figure 6:
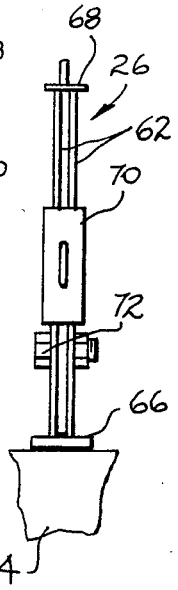
FIG. 6 is a side elevational view of the support bracket shown in FIG. 5.

In assembling the first guide means 20, a plurality of support brackets 26 are bolted to outer ends of some of the spokes 57. At least two but preferably three or four equally spaced support brackets can be utilized. As shown in FIG. 5, each support bracket includes a pair of vertical plates 62 spaced apart to minimize the bracket weight while providing adequate support. Plates 62 have aligned apertures 64 therethrough and are connected together by a bottom plate 66, the upper plate 68 of a lifting eye, which lifting eye hook point is aligned with the center of gravity of the bracket for stability during lifting thereof, and a side plate 70 of another lifting eye. Apertures 64 are aligned with apertures through the end of spokes 57 to receive bolts, one of which is shown at 72. As shown in FIG. 5, the support bracket 26 increases the effective outer diameter of the respective frame structure 24*c*, 24*e* and 24*g* so that bottom plate 66 rests on the top of interior pile 4.

In assembly, the first or lowest section with vertical center post 22*a* is lowered into the open top end of pile 4 until the bolted on support brackets 26 rest on the top edge of the pile as shown in FIG. 5. The next section with vertical center post 22*b* is then lowered and stabbed to the lower section. After this section is rotated to a preferably keyed position to align its conductor openings 58 and 60 with those of other sections, the two center posts 22*a* and 22*b* are then welded together.

The two sections which are now assembled are then lifted slightly to permit removal of support brackets 26 from structure 24*c* and then lowered into the interior pile 4 until brackets 26 which have previously been connected to frame structure 24*e* rest on the open top of the pile. Thereafter the next higher section having center post 22*c* is lowered, stabbed, and welded to the section having center post 22*b*, and the support brackets are thereafter removed from structure 24*e*. This process continues until the top section carrying center post 22*d* is lowered. Since it carries the upper structure 24*h*, it automatically rests on the top edge of pile 4 and permanently supports the remaining sections.

It is customary to provide steel frame structures for positioning the conductors 10 at 40 to 60 foot intervals in the interior pile 4.

Referring now to FIGS. 7 through 9, the second guide means 30 includes a cover plate 32 which is cambered as shown in FIG. 8 and includes a plurality of aligned openings 39 which define passages for receiving and positioning the conductors 10. Plate 32 is of such a diameter that the outer periphery of plate 32 can overlie an opening in the upper deck and rest on the upper deck portions which lie adjacent to and define such opening. It is preferred that plate 32 rest on a plurality of upper deck beams 38 to assure adequate support. Referring to FIG. 7, it should be noted that the conductor passages are not symmetrically positioned. Thus, if the second guide means 30 is to be constructed at an onshore site for installation at the platform, the conductor openings may be provided therein at the onshore site but the conductor openings must align with the conductor openings of the first guide means 20 when the second guide means 30 is installed. In order to achive such alignment in accordance with the present invention, the plate 32 is provided to be circular to rotate about its center over beams 38, and small lengths of angle iron 35, which are welded to beams 38, extend along and are spaced about the cover plate circumference and extend over the periphery of plate 32 to maintain its center position. Three lifting eyes 37 are welded to cover plate 32 for lifting the plate.

It was discovered that such a single plate 32, which may typically have a diameter of 17 feet, will tend to deflect under its weight, resulting in its conductor passages not remaining aligned with the first guide means conductor passages. In order to reduce such deflection so that the alignment is maintained in accordance with a preferred embodiment of the present invention, the second guide means 30 is also provided with a circular and similarly cambered and apertured lower plate 34 which has a diameter which is less than the cover plate diameter to fit within the space of the lower deck opening and between the beams 38, as shown in FIG. 8. Openings 39 may be outfitted with suitable sleeves as illustrated at 41 in FIG. 7 for receiving the conductors. The cover and lower plates 32 and 34 respectively are spaced apart and connected together by a circular ring 36 welded to the plates 32 and 34 and sleeves 41 to further increase the rigidity and resistance to deflection thereof.

In manufacturing the platform at the land based facility, plate 32 is spot welded into place at short weld locations. At the offshore site, these weld locations are torch cut so that plate 32 with its connected ring 36 and lower plate 34, can be rotated to align the passages defined by openings 39 with the passages already defined in the first guide means of the interior pile 4. Conductors 10 can thus be slipped through openings 39 and into their positioning passages in the first guide means.

While only a single second guide means is shown, a plurality of lower decks may be provided. Each of these additional lower decks, or only some of them, may be outfitted with a second guide means 30 as illustrated in FIGS. 7 through 9.

Referring now to FIGS. 10 through 13, the upper deck is equipped with third guide means 40 having a center hub 42 with radially extending steel beams 44 configured as the spokes of a wheel and overlying an opening in the upper deck. As shown in FIG. 10, beams 44 define sector shaped generally triangular areas which may each provide access to the tops of a plurality of conductors 10 which are actually below the upper deck as viewed from FIG. 10. Each of these areas may be covered by a hatch 46, shown in FIG. 11, having its own frame structure 48. Seat plates 47 are bolted or welded to beams 44 for supporting the hatches 46 which can be bolted to these seat plates for easy removal and access to the tops of the conductors 10.

The upper deck is provided with deck beams 50 forming seats on which outer edges of beams 44 can rest and permitting rotation of the circular second guide means 40 about the hub 42 to align the passages with the configuration of conductors. After alignment, the outer edges of beams 44 can be bolted or welded to beams 50.

Since rotation of the third guide means 40 through a small angle covering the diameter of a conductor passage 39 is considered sufficient to align the third guide means pre-shaped openings with the second guide means passages. Thus, it is considered sufficient if the deck beams 50 extend over a distance circumferentially of the third guide means equal to half of the conductor passage diameter on each side of a radius from the hub which lies in a plane which passes between a pair of adjacent inner row conductor passages 39 of the second guide means 30.

Although the beams 44 may be either welded or bolted to the hub 42 and beams 50, it is preferred that some beams 44 be bolted to allow their removal so that openings may be provided which are large enough to pass large apparatus such as blowout preventers therethrough, and that others of the beams 44 be welded to provided support without the danger of the third guide means falling to a lower deck if all of the beams were unbolted. For example, alternate beams may be welded, and alternate beams may be bolted.

Some features of the present invention can be used to advantage without use of other features of the invention. While a specific embodiment of the invention has been shown and described in detail to illustrate the application of the principles of the invention, it will be understood that the invention may be embodied otherwise without departing from such principles.

What is claimed is:

1. A conductor guide arrangement for an offshore well platform having a jacket and at least one upper deck and at least one lower deck connected to the jacket comprising:

a pile extending from a sea bed to above a water level over the sea bed;

first guide means disposed in and supported by the pile for positioning a plurality of conductors in the pile;

second guide means associated with the at least one lower deck and defining a plurality of passages therethrough for positioning said plurality of conductors, said second guide means is rotatable to align said passages thereof with the plurality of conductors during installation and is fixable to the at least one lower deck;

third guide means associated with said upper deck comprising a hub and a plurality of beam members extending radially outwardly of said hub and defining a further plurality of passages therethrough for alignment with said passages of said second guide means, said third guide means being rotatable to align said further passages with said passages of said second guide means during installation and being fixable to said upper deck;

means defining an opening in the upper deck and supporting said radial beam members for permiting rotation of said third guide means with respect to the upper deck;

hatch means comprising a plurality of substantially trianglar sector-shaped hatches removably connected to said radial beams for covering said passages; and a plurality of seat plates connectable to said hatches and connected to each of said radial members for supporting said hatch means.

2. A conductor guide arrangement according to claim 1 further comprising members which are affixed to the lower deck and which spaced about the cover plate circumference have portions which extend over a periphery of said cover plate to maintain a centered position of said cover plate.

3. A conductor guide arrangement according to claim 1 wherein said second guide means comprises a cover plate having a plurality of apertures therethrough and a circular lower plate having a plurality of apertures therein aligned with said apertures of said cover plate and forming said plurality of passages, means fixedly connecting said cover and lower plates, said cover plate having an outer diameter greater than the outer diameter of said lower plate for support on support means defining an opening in the at least one lower deck, said cover plate being removably connected to the at least one lower deck to permit rotation of said second guide means with respect to the at least one lower deck for alignment of said passages during installation thereof.

4. A conductor guide arrangement according to claim 3 wherein said connecting means comprises a ring member connected between said cover and lower plates.

5. A conductor guide arrangement according to claim 4 wherein said cover and lower plates are each cambered to be convex as viewed from upwardly thereof.

6. A conductor guide arrangement for an offshore well platform having a jacket, a lower deck and an upper deck comprising;

a pile extending from a sea bed to above a water level over the sea bed;

first guide means disposed in and supported by the pile for positioning a plurality of conductors in the pile;

second guide means associated with said lower deck and defining a plurality of passages therethrough for positioning said plurality of conductors, said second guide means being rotatable to align said passages thereof with the plurality of conductors during installation and being fixable to said lower deck;

third guide means associated with the upper deck comprising a hub, a plurality of beam members extending radially outwardly of said hub and defining a plurality of passages therethrough for alignment with said plurality of conductors, said third guide means is rotatable to align said passages with said conductors during installation and is fixable to the upper deck;

means defining an opening in the upper deck and supporting said radial beam members for permitting rotation of said third guide means with respect to the upper deck;

hatch means comprising a plurality of substantially triangular sector-shaped hatches removably connected to said radial beams for covering said passages; and a plurality of seat plates connectable to said hatches and connected to each of said radial members for supporting said hatch means.

7. A conductor guide arrangement according to claim 6 wherein said means defining an opening in the upper deck comprises of plurality of arcuate beam sections connected to said upper deck.

8. A conductor guide arrangement according to claim 7 wherein some of said beam members are welded to said hub and said arcuate beam sections for permanently affixing said third guide means to said upper deck, and some of said beam members are removably affixed to said hub and said arcuate beam sections for removal thereof to pass large apparatus through said upper deck opening.

9. A method of assembling a conductor guide arrangement for a plurality of conductors of an offshore well platform including a jacket and at least one lower deck comprising:

preparing a second guide arrangement having a circular cover plate and a plurality of openings in the cover plate defining a plurality of passages for the conductors;

temporarily connecting the cover plate to be at least one lower deck to overlie an opening in the at least one lower deck at a land based facility;

transporting the jacket with the at least one lower deck and temporarily connected cover plate to an offshore location;

preparing a first guide arrangement for guiding conductors in a pile which extends from a sea bed to above a water level over the sea bed;

cutting the temporary connections between the cover plate and the at least one lower deck;

rotating the cover plate to align the passages thereof with positions for conductors in the pile; and permanently connecting the cover plate to the at least one lowermost deck.

10. A method according to claim 9 wherein the platform includes an upper deck further comprising:

preparing a third guide arrangement having a center hub with a plurality of radially extending beams;

connecting beam sections having a plurality of seats to the upper deck;

temporarily supporting the third guide arrangement on the seats to overlie an opening in the upper deck; and rotating the third guide arrangement to align openings between the radial beams thereof with conductor passages of the second guide means.

11. A method according to claim 9 further comprising connecting the cover plate to a lower plate by welding a ring member to the cover and lower plates, the lower plate having a plurality of openings aligned with the cover plate openings thereby providing the plurality of conductor passages, and the lower plate further have a smaller diameter than the diameter of the cover plate to lie within the lower deck opening.

12. A method according to claim 11 further comprising maintaining a centered position of the cover plate by affixing members on the lower deck which are spaced about the cover plate circumference and which have portions which extend over a periphery of the cover plate.

13. A method of assembling a conductor guide arrangement for a plurality of conductors of an offshore well platform including a jacket, at least one lower deck, and an upper deck comprising;

preparing a third guide arrangement having a center hub and a plurality of radially extending beams;

connecting beam sections having a plurality of seats to the upper deck;

temporarily supporting the third guide arrangement on the seats to overlie an opening in the upper deck;

transporting the jacket with the upper deck and temporarily connected third guide arrangement to an offshore location;

installing a first guide arrangement for guiding conduction in a pile which extends from a sea bed to above a water level over the sea bed;

installing a second guide arrangement on the lower deck with passages therein which align with positions of the conductors in the pile;

rotating the third guide arrangement to align openings therein between the radial beams with conductor passages of the second guide arrangement.

14. A method according to claim 13, including bolting some of the radial beams to the center hub and respective ones of the seats, welding some of the radial beams to the center hub and respective ones of the seats, and positioning substantially triangular hatches over the openings between the radial beams of the third guide arrangement.

* * * * *